US005896107A

United States Patent [19]

Huynh

[11] Patent Number: 5,896,107

[45] Date of Patent: Apr. 20, 1999

[54] DUAL POLARIZED APERTURE COUPLED MICROSTRIP PATCH ANTENNA SYSTEM

[75] Inventor: Tan D. Huynh, Hurst, Tex.

[73] Assignee: Allen Telecom Inc., Solon, Ohio

[21] Appl. No.: 08/863,779

[22] Filed: May 27, 1997

[51] Int. Cl.[6] ..... H01Q 1/38

[52] U.S. Cl. ..... 343/700 MS; 343/817

[58] Field of Search ..... 343/700 MS, 815, 343/817, 834, 770, 816

[56] References Cited

U.S. PATENT DOCUMENTS

| | | | |
|---|---|---|---|
| 4,903,033 | 2/1990 | Tsao et al. | 343/700 MS |
| 5,043,738 | 8/1991 | Shapiro et al. | 343/700 MS |
| 5,220,335 | 6/1993 | Huang | 343/700 MS |
| 5,355,143 | 10/1994 | Zurcher et al. | 343/700 MS |
| 5,448,250 | 9/1995 | Day | 343/700 MS |
| 5,596,337 | 1/1997 | Merenda | 343/770 |
| 5,689,262 | 11/1997 | James | 343/834 |
| 5,710,569 | 1/1998 | Oh et al. | 343/817 |
| 5,717,407 | 2/1998 | Hong | 343/700 MS |

*Primary Examiner*—Don Wong
*Assistant Examiner*—Hoang Nguyen
*Attorney, Agent, or Firm*—Laff, Whitesel, Conte & Saret, Ltd.

[57] ABSTRACT

A dual polarized aperture coupled patch antenna system having a back plate, a ground plane and a patch plane. The patch plane has a conductive patch layer forming a plurality of conductive patches on one side. The ground plane has a slot layer on one side and a microstrip feed network layer on the opposite side. The ground plate is positioned between the patch plane and the back plate, with the slot layer confronting the conductive patch layer of the patch plane and the microstrip feed network layer confronting the back plate. The slot layer comprises a conducting coating having a plurality of intersecting polarization slot pairs etched into the coating. The microstrip feed network layer comprises two feed lines and a plurality of feed probes. Two feed probe members are coupled to each conductive patch through one arm of each slot pair and one feed probe member is coupled to each conductive patch through each other slot pair. This arrangement provides dual polarization with effective cross polarization port-to-port isolation using only one microstrip feed network layer and without the use of jumpers of crossovers.

22 Claims, 3 Drawing Sheets

DUAL POLARIZED APERTURE COUPLED MICROSTRIP PATCH ANTENNA SYSTEM

BACKGROUND OF THE INVENTION

This invention is related generally to a dual polarized aperture coupled microstrip patch antenna system. A variety of aperture coupled patch antenna systems are available and known. Prior art dual polarization aperture coupled patch antenna systems suffer from either small bandwidth, poor cross polarization port-to-port isolation (about −20 dB) or require complicated and expensive feed structures including multiple feeding network layers or jumpers or crossovers.

Accordingly, a need arises for a dual polarized aperture coupled patch antenna system having an uncomplicated, inexpensive feeding structure with effective cross polarization port-to-port isolation.

SUMMARY OF THE INVENTION

These needs and others are satisfied by the dual polarization aperture coupled patch antenna system of the present invention. The dual polarized aperture coupled patch antenna system of the present invention comprises an insulative patch plane, a back plate and a ground plane which are generally parallel to each other.

The insulative patch plane includes a conductive patch layer on one side of the patch plane which forms a plurality of spaced apart conductive patches. The conductive patches act as the radiating elements of the antenna system. In the preferred embodiment, the conductive patches are rectangular and have a length of approximately one-half wavelength and the insulative patch plane is fiberglass.

The ground plane is positioned between the back plate and the patch plane. The side of the ground plane confronting the patch plane bears a slot layer. The opposite side of the ground plane bears a microstrip feed network layer.

The slot layer comprises a conductive coating having a plurality of polarization slots which may be etched into the conductive coating. The slots are arranged in pairs comprised of intersecting first and second polarization slot elements, with one pair confronting each conductive patch. In the preferred embodiment, the slots are rectangular and have a length of less than one-half wavelength.

The microstrip feed network layer comprises two independent feed lines and a plurality of feed probes. A first set of feed probes is connected to the transmission line by the first feed line and a second set of feed probe members is connected to the transmission line by the second feed line.

The first set of feed probes comprises pairs of feed probe members which are capacitively coupled to the conductive patches through the first polarization slots. The second set of feed probes comprises single feed probe members which are capacitively coupled to the conductive patches through the second polarization slots.

The polarization slots provide radio frequency transition between the feed probes and the conductive patches. Coupling through the first polarization slots causes polarization in a first direction and coupling through the second polarization slots causes polarization in a second direction.

This feed probe arrangement facilitates dual polarization with effective cross polarization port-to-port isolation, typically in the −32 dB range, by allowing coupling through both the first and second polarization slots to be accomplished through the use of a single microstrip feed network layer without jumpers or cross-over connectors. The configuration uses a minimal number of solder joints making it simple, efficient and much less costly than available systems.

In one embodiment of the present invention, the base plate is made of extruded metal and includes integrally formed wings for enhancing the horizontal beamwidth of the antenna system. Alternatively, the base plate can include baffles for enhancing the horizontal beamwidth. Parasitic elements may also be added to the patch plane to further enhance the horizontal beamwidth.

Undesirable cross polarization components created by any radio frequency radiation reflected back to the polarization slots from the back plane can be reduced by truncating the corners on selected conductive patches. In addition, each first polarization slot can be offset with respect to each second polarization slot to further reduce the cross polarization and improve port-to-port isolation of the antenna system.

Further objects, features and advantages of the present invention will become apparent from the following description and drawings.

DETAILED DESCRIPTION OF THE INVENTION

Figure 1:
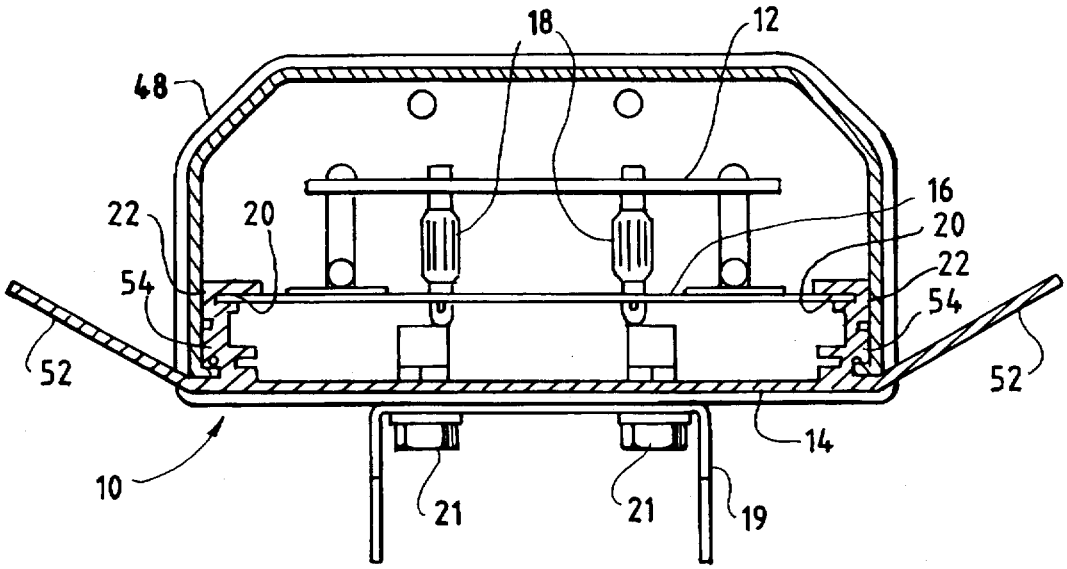
FIG. 1 is a cross-sectional view of an assembled antenna system of the present invention.
Figure 2:
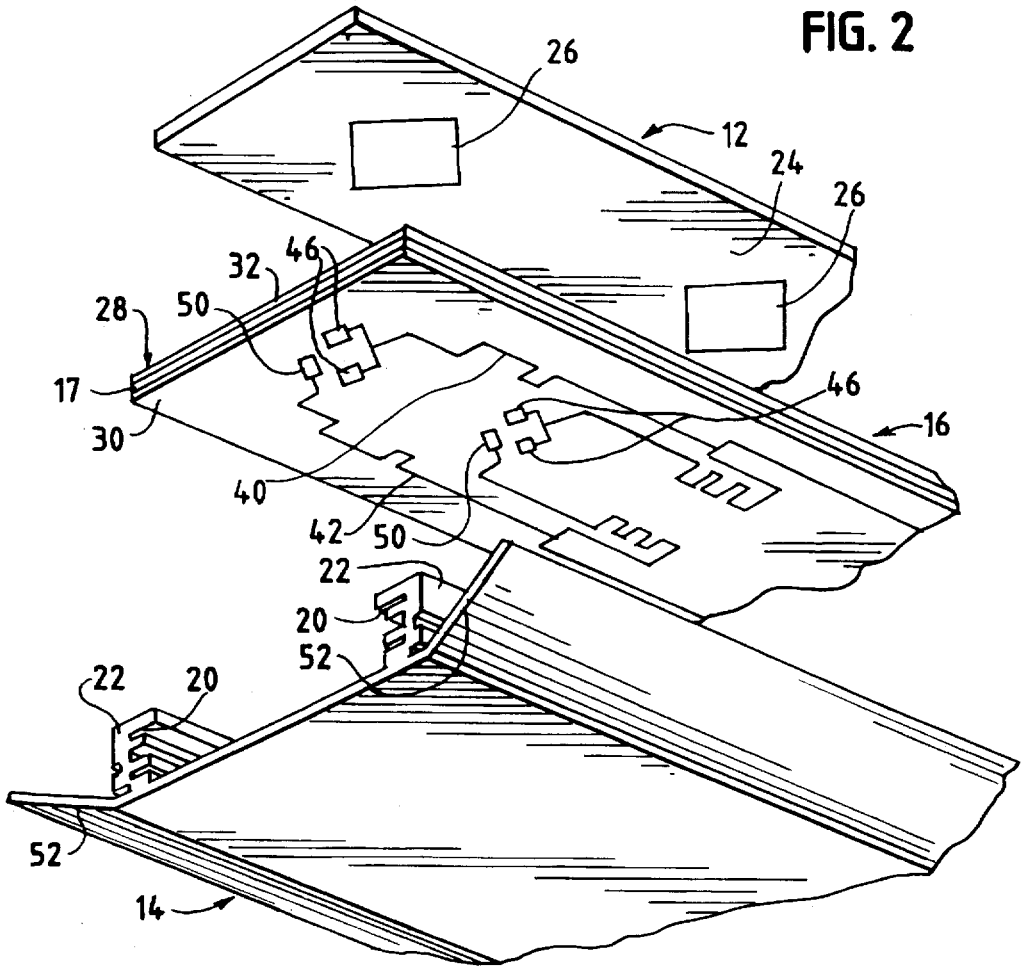
FIG. 2 is an exploded perspective view of the antenna system of FIG. 1.
Figure 3:
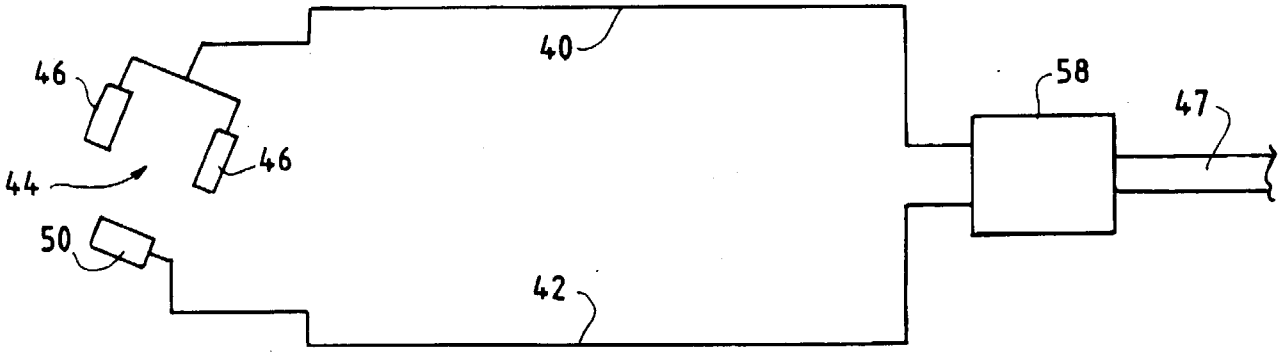
FIG. 3 is a schematic diagram of the feed probe members, feed lines, connector and transmission line of FIG. 2.
Figure 4:
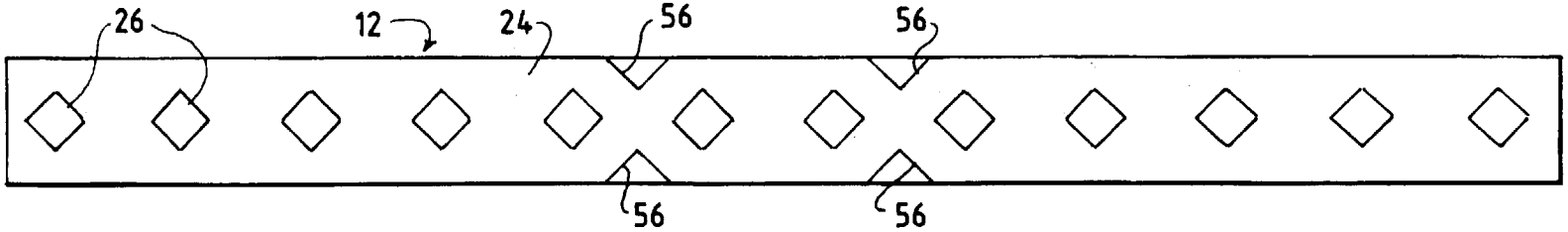
FIG. 4 is a plan view of the patch plane of FIG. 1.
Figure 5:
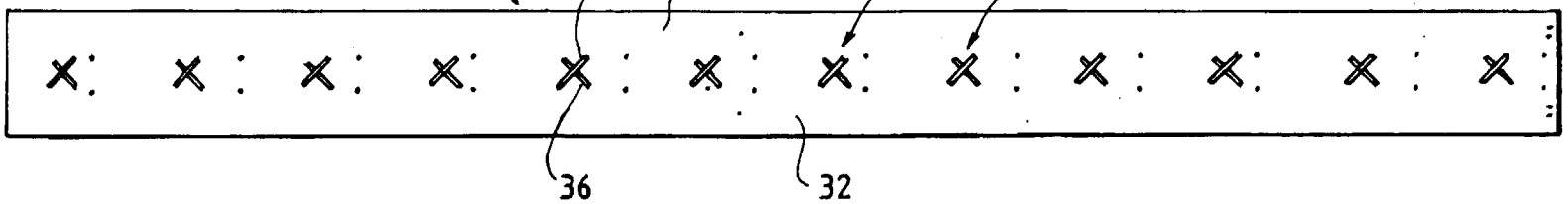
FIG. 5 is a plan view of the ground plane of FIG. 1 showing the slot layer of the ground plane.
Figure 6:
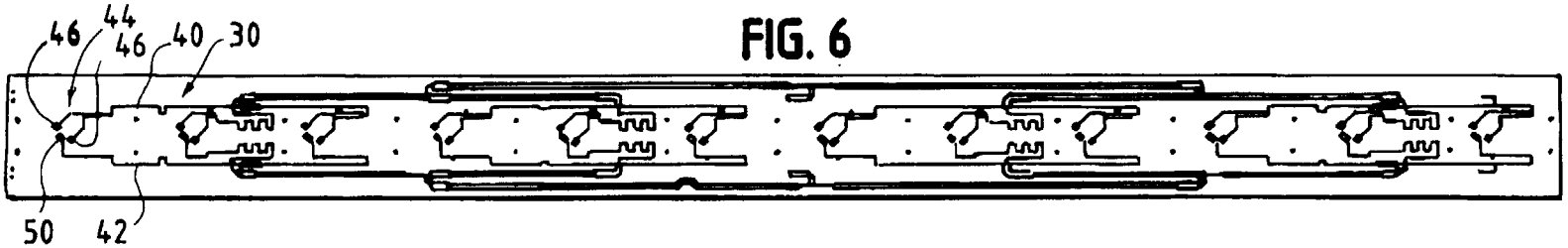
FIG. 6 is a plan view of the ground plane of FIG. 4 showing the microstrip feed network layer of the ground plane.

In accordance with the present invention, a dual polarization aperture coupled patch antenna system is described that provides distinct advantages when compared to those of the prior art. The invention can best be understood with reference to the accompanying drawing figures.

Referring now to the drawings, a dual polarized aperture coupled patch antenna system of the present invention, generally indicated at 10, comprises an elongated insulative patch plane 12, an elongated back plate 14, which may be an aluminum extrusion, and an elongated ground plane 16 which is positioned between and spaced apart from back plate 14 and patch plane 12. Patch plane 12, back plate 14 and ground plane 16 are all housed in a housing, such as a radome 48, and are held in place substantially parallel to each other. Patch plane 12 is mounted to ground plane 16 by suitable fasteners 18. Ground plane 16 is held in place above back plate 14, between back plate 14 and patch plane 12, by placement grooves 20 in the sides 22 of back plate 14.

Antenna system 10 is typically secured to a mounting structure (not shown), such as a building. In the preferred embodiment, a mounting bracket 19 is attached to back plate 14 by a pair of suitable fasteners 21. Mounting bracket 19 is used to secure the back plate 14 and thus the antenna system 10 to the mounting structure. Antenna system 10 is configured to be mounted with the length of the patch plane 12, back plate 14 and ground plane 16 generally vertical to the earth's surface.

Patch plane 12 includes a conductive patch layer 24 on the side of patch plane 12 confronting ground plane 16. Conductive patch layer 24 forms a plurality of spaced apart conductive patches 26. Conductive patches 26 are spaced lengthwise alone the length of patch plane 12. Conductive patches 26 act as the radiating elements and form an array of radiating elements for antenna system 10.

In the preferred embodiment, conductive patches 26 are rectangular and have a length of approximately one-half wavelength. Patch plane 12 is made of a 0.032 inch thick fiberglass board and conductive patches 26 are formed, as from a conductive ink silk-screened onto patch plane 12.

Ground plane 16 comprises solely a non-conductive, dielectric body 17, sandwiched between a slot layer 28 and a microstrip feed network layer 30. In the preferred embodiment, body 17 comprises a fiberglass filled polytetrafluoroethylene board. Slot layer 28 is positioned parallel to and confronting patch plane 12 and microstrip feed network layer 30 confronts back plate 14.

Slot layer 28 comprises a conductive coating 32, deposited onto body 17, as by standard printed circuit board fabrication techniques, with a plurality of polarization slots 34 etched into coating 32. Thus, slots 34 themselves are non-conductive and are defined by the surrounding conductive material. Polarization slots 34 are arranged in pairs of intersecting first and second slot elements 36 and 38, respectively, to form X-shaped apertures, with one pair of slot elements 36, 38 confronting each conductive patch 26. In the preferred embodiment, slot elements 36, 38 are rectangular and have lengths of less than one-half wavelength.

Microstrip feed network layer 30 comprises two feed lines 40 and 42 and a plurality of feed probes which are capacitively coupled to conductive patches 26 through polarization slots 34. A first set of feed probes 46 is adapted to be connected to a transmission line 47 by feed line 40 via a connector. A second set of feed probes 50 is adapted to be connected to transmission line 47 by feed line 42 via a connector 58. In the preferred embodiment, the transmission line 47 is a shielded coaxial cable and the connector 58 is a coaxial connector.

The first set of feed probes 46 comprises a plurality of pairs of feed probe members which are capacitively coupled to conductive patches 26 through first polarization slot elements 36. The second set of feed probes 50 comprises a plurality of single feed probe members which are capacitively coupled to conductive patches 26 through second polarization slot elements 38.

Polarization slots 34 provide radio frequency transition between the feed probes and the conductive patches 26. Coupling through first polarization slot elements 36 causes polarization in a first direction and coupling through second polarization slot elements 38 causes polarization in a second direction orthogonal to the first direction when the slot elements intersect orthogonally.

Figure 7:
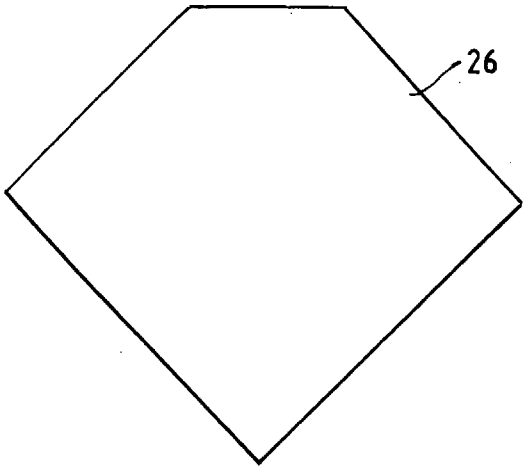
FIG. 7 is a plan view of an alternative embodiment of the conductive patch of FIG. 4.

Once antenna system 10 is assembled, undesirable radio frequency radiation radiated from the polarization slots to back plate 14 can be reflected back by back plate 14 to the polarization slots to create an undesirable cross polarization component which effects port-to-port isolation of antenna system 10. To avoid or overcome the effect of such reflection, and to optimize the antenna system port-to-port isolation, the corners of selected conductive patches 26 may desirably be truncated, as shown by FIG. 7.

Figure 8:
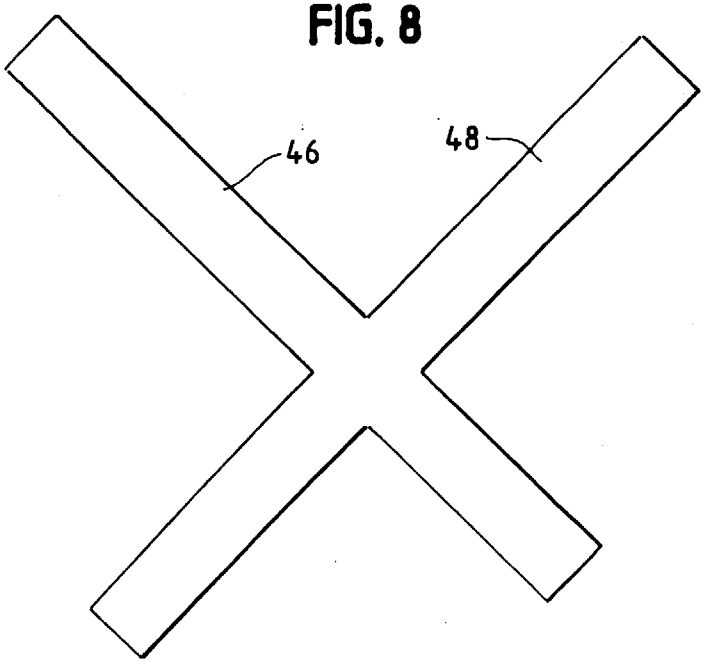
FIG. 8 is a plan view of the offset polarization slots of FIG. 5.

Such antenna system port-to-port isolation can also be improved by offsetting first slot members 36 with respect to second slot members 38 as shown by FIG. 8. In a preferred offset configuration, first slot members 36, which are each fed by a pair of feed probe members, intersect the second slot members 38, which are each fed by a single feed probe member, substantially at the center of the second slot members 38. However, the second slot members 38 intersect the first slot members 36 at a location offset from the center of the first slot members 36, thus creating the preferred offset configuration.

Truncating the patch corners or offsetting the slots members creates a radio frequency cross polarization component which cancels out the reflected cross polarization component. In the preferred embodiment, port-to-port isolation in the −32 dB range can be achieved.

In the preferred embodiment, base plate 14 is an aluminum extrusion, and includes associated wings 52, such as integrally formed wings 52 for enhancing the horizontal beamwidth of antenna system 10. Additionally or alternatively, base plate 14 can include baffles 54 for enhancing horizontal beamwidth.

Connectors 58 are provided for connecting the transmission line to antenna system 10. As stated, a radome 48 is also provided for enclosing and protecting the components of antenna system 10.

Strategically located parasitic elements 56 can be added to patch plane 12 for further enhancing horizontal beamwidth. Parasitic elements 56 may be formed from conductive ink silk-screened onto the side of patch plane 12 confronting ground plane 16.

It will be apparent to those skilled in the art that modifications may be made without departing from the spirit and scope of the invention. Accordingly, it is not intended that the invention be limited except as may be necessary in view of the appended claims.

What is claimed is:

1. A dual polarized aperture coupled patch antenna system for connection to a transmission line, said antenna system comprising:

an elongated insulative patch plane having a conductive patch layer on a first side of said patch plane, said conductive patch layer comprising a plurality of conductive patches spaced apart along the length of said patch plane;

an elongated back plate lying generally parallel to said patch plane;

an elongated ground plane positioned between said patch plane and said back plate with said ground plane confronting said first side of said patch plane and lying substantially parallel to said patch plane;

a slot layer on a first side of said ground plane confronting said patch plane first side, said slot layer comprising a conductive coating covering said ground plane first side, said conductive coating having a plurality of pairs of first polarization slots and second polarization slots along the length of said ground plane with a pair confronting each of said plurality of conductive patches;

an elongated microstrip feed network layer on a second side of said ground plane, said feed network layer comprising a plurality of feed probes and first and second feed lines, said first feed line for connecting a first set of feed probes to the transmission line and said second feed line for connecting a second set of feed probes to the transmission line, said first set of feed probes comprising pairs of feed probe members being coupled to said plurality of conductive patches through said plurality of first polarization slots, and said second set of feed probes comprising single feed probe members coupled to said plurality of conductive patches through said plurality of second polarization slots, said coupling through said first polarization slots causing polarization in a first direction and coupling through said second polarization slots causing polarization in a second direction.

2. The antenna system of claim 1 wherein each said polarization slot is rectangular.

3. The antenna system of claim 2 wherein each said polarization slot is less than one-half wavelength in length.

4. The antenna system of claim 1 wherein each said conductive patch is substantially rectangular.

5. The antenna system of claim 4 wherein each said conductive patch is approximately one-half wavelength in length.

6. The antenna system of claim 4 wherein one corner of a portion of said conductive patches is truncated to improve port-to-port isolation of said antenna system.

7. The antenna system of claim 1 wherein said first and second polarization slots intersect to form an X-shaped aperture for feeding each said conductive patch.

8. The antenna system of claim 7 wherein the first polarization slot of each said pair is offset with respect to each said second polarization slot of each said pair to improve isolation of said antenna system.

9. The antenna system of claim 1 wherein said conductive patch layer further comprises parasitic elements.

10. The antenna system of claim 1 further comprising wings electrically connected to said back plate for enhancing horizontal beamwidth of said antenna system.

11. The antenna system of claim 1 further comprising baffles electrically connected to said back plate for enhancing horizontal beamwidth of said antenna system.

12. A dual polarized aperture coupled patch antenna system for connection to a transmission line, said antenna system comprising:

an elongated insulative patch plane having a conductive patch layer on a first side of said patch plane, said conductive patch layer comprising a plurality of conductive patches spaced apart along the length of said patch plane;

an elongated back plate lying generally parallel to said patch plane;

an elongated ground plane positioned between said patch plane and said back plate with said ground plane confronting said first side of said patch plane and lying substantially parallel to said patch plane, said ground plane comprising a non-conductive, dielectric body having parallel main sides, a first conductive layer on a first main side of said body and a second conductive layer on a second main side of said body opposite said first main side;

said first conductive layer having a plurality of pairs of first polarization slots and second polarization slots along the length of said ground plane, said first polarization slots and said second polarization slots comprising non-conductive portions of said ground plane which are exposed through said first conductive layer and defined by surrounding conductive material, one of said pairs of first and second polarization slots confronting each of said plurality of conductive patches;

said second conductive layer comprising a feed network including a plurality of feed probes and first and second feed lines, said first feed line for connecting a first set of feed probes to the transmission line and said second feed line for connecting a second set of feed probes to the transmission line, said first set of feed probes comprising pairs of feed probe members being coupled to said plurality of conductive patches through said plurality of first polarization slots, and said second set of feed probes comprising single feed probe members coupled to said plurality of conductive patches through said plurality of second polarization slots, said coupling through said first polarization slots causing polarization in a first direction and coupling through said second polarization slots causing polarization in a second direction;

wherein said antenna system is characterized by a feed network comprising a single conductive layer and by the absence of additional feed network layers, jumpers or cross-over connectors.

13. The antenna system of claim 12 wherein each said polarization slot is rectangular.

14. The antenna system of claim 13 wherein each said polarization slot is less than one-half wavelength in length.

15. The antenna system of claim 12 wherein each said conductive patch is substantially rectangular.

16. The antenna system of claim 15 wherein each said conductive patch is approximately one-half wavelength in length.

17. The antenna system of claim 15 wherein one corner of a portion of said conductive patches is truncated to improve isolation of said antenna system.

18. The antenna system of claim 12 wherein said first and second polarization slots intersect to form an X-shaped aperture for feeding each said conductive patch.

19. The antenna system of claim 18 wherein the first polarization slot of each said pair is offset with respect to each said second polarization slot of each said pair to improve isolation of said antenna system.

20. The antenna system of claim 12 wherein said conductive patch layer further comprises parasitic elements.

21. The antenna system of claim 12 further comprising wings electrically connected to said back plate for enhancing horizontal beamwidth of said antenna system.

22. The antenna system of claim 12 further comprising baffles operably connected to said back plate for enhancing horizontal beamwidth of said antenna system.

* * * * *